US007841379B1

(12) United States Patent
Evans

(10) Patent No.: US 7,841,379 B1
(45) Date of Patent: Nov. 30, 2010

(54) METHOD AND SYSTEM FOR PUMPING MOLTEN METAL

(76) Inventor: Dwight Evans, 15 Timothy Trace, Anniston, AL (US) 36207

( * ) Notice: Subject to any disclaimer, the term of this patent is extended or adjusted under 35 U.S.C. 154(b) by 364 days.

(21) Appl. No.: 12/218,951

(22) Filed: Jul. 18, 2008

(51) Int. Cl.
*B22D 35/04* (2006.01)

(52) U.S. Cl. ..... 164/133; 164/337

(58) Field of Classification Search ..... 164/133–136, 164/335–337
See application file for complete search history.

(56) References Cited

U.S. PATENT DOCUMENTS

2008/0277091 A1* 11/2008 Beale et al. ..... 164/336

* cited by examiner

*Primary Examiner*—Kuang Lin
(74) *Attorney, Agent, or Firm*—Richard K. Thomson

(57) ABSTRACT

Method and apparatus for pumping molten metal from a reservoir into a preferably bottom-filled mold includes a pair of graphite pump crucibles partially submerged in a reservoir of molten metal. Check valves in the bottom of each crucible enable them to be filled to the same level as the reservoir. A high pressure inert gas supply operating through a pressure regulator, forces the molten metal from one of the crucibles up a riser tube to a horizontally extending runner and through a fill port into the mold. The pressure supply is then connected to the other crucible while the first refills.

6 Claims, 1 Drawing Sheet

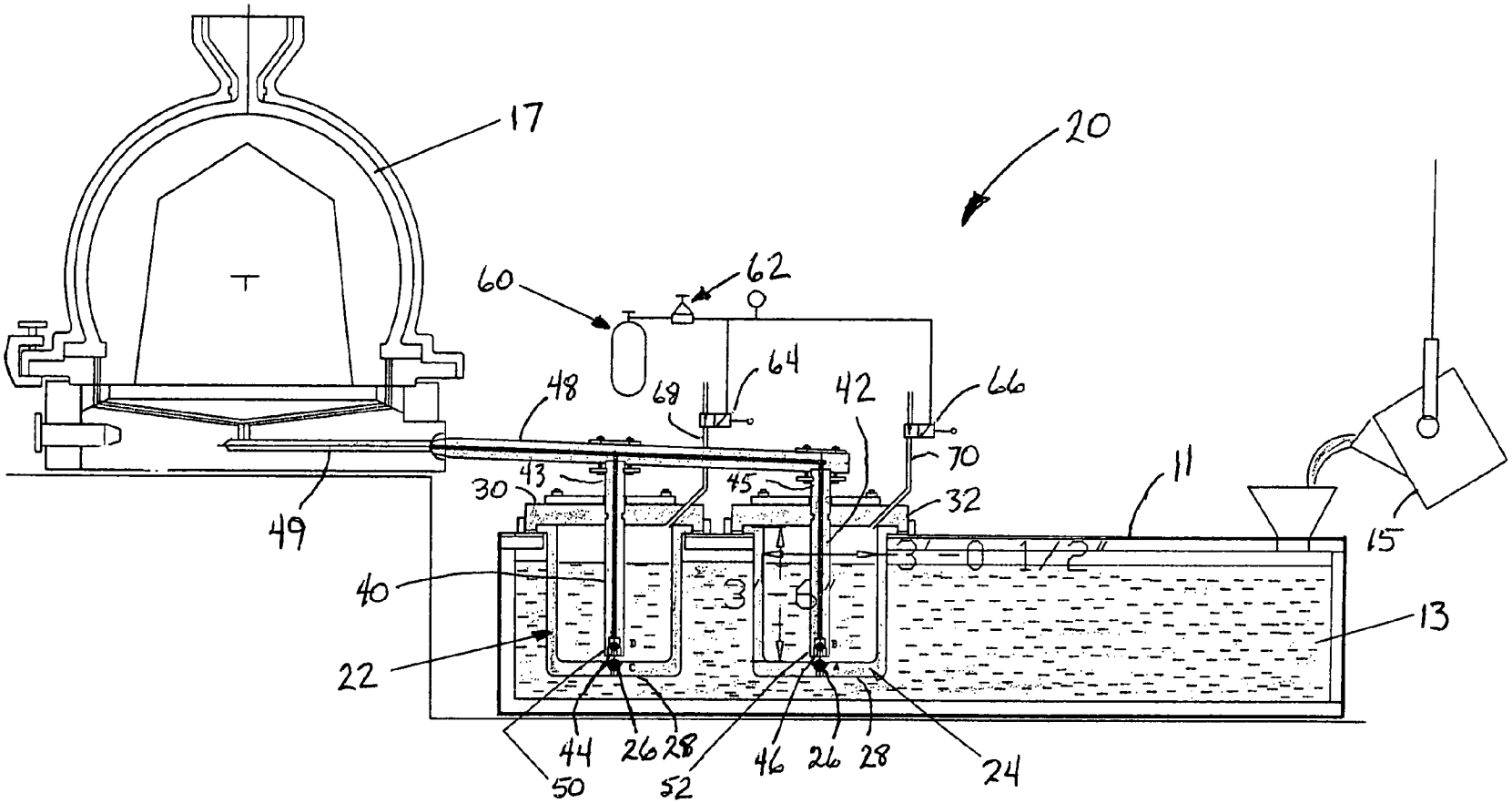
20
15
13
11
66
70
32
24
42
28
26
46
62
64
45
52
69
28
26
44
50
48
43
30
60
17
40
22
49

METHOD AND SYSTEM FOR PUMPING MOLTEN METAL

BACKGROUND AND SUMMARY OF THE INVENTION

The present invention is directed to field of casting molten metal. More particularly, the present invention is directed to a dual pump system and method of bottom filling a casting.

Conventional mold-filling methods involve filling a sand mold from the top through a sprue hole. Such a technique can result in creation of eddy currents which produce defects in the casting. If the defect goes beneath the surface, or if the article is a precision casting, such eddy currents can require scrapping of the entire casting. In their earlier patent, U.S. Pat. No. 7,213,634 entitled Offset Molding Process, Applicants have described one method of providing a suitable solution for obviating these eddy currents by bottom-filling the mold. However, that process has limited applicability in larger molds. The present invention is directed to a pumping system and a method for bottom-filling large molds by utilizing twin pumps which empty two identical crucibles by switching between the two to provide a continuous flow of molten metal to prevent the early fill from taking a set before the mold fill operation is complete.

The system of the present invention comprises a) a reservoir filled with molten metal to a first depth; b) a first pump crucible partially submerged in the reservoir, the first pump crucible having a first check valve positioned in a passageway in a bottom wall of the first pump crucible such that the first pump crucible will fill with molten metal to a second depth equal to the first depth; c) a riser tube extending upwardly from the first pump crucible, a first check valve in a bottom end of the riser tube to prevent downward flow of molten metal in the riser tube; d) a horizontally extending runner interconnecting the riser tube with a fill port in the bottom-fill mold; e) a high pressure source of inert gas interconnected to the first pump crucible by a gas delivery system including piping, at least one flow valve and a pressure regulator; whereby opening the at least one flow valve permits the inert gas to force the molten metal in the first pump crucible up the riser tube through the horizontally extending runner into the mold through the fill port.

The system further comprises a second pump crucible partially submerged in the reservoir, the second pump crucible having a second check valve positioned in a passageway in a bottom wall of the second pump crucible such that the second pump crucible will fill with molten metal to a third depth equal to the first depth. The at least one flow valve comprises a control valve for each of the first and the second pump crucibles and control means to enable switching between the first and the second pump crucible.

More preferably, the system for pumping molten metal to bottom fill a mold, comprising includes a) a reservoir filled with molten metal to a first depth; b) a first pump crucible submerged in the reservoir, the first pump crucible having a first check valve positioned in a passageway in a bottom wall of the first pump crucible such that the first pump crucible will fill with molten metal to a second depth equal to the first depth; c) a first riser tube extending upwardly from the first pump crucible, a first check valve in a bottom end of the riser tube to prevent downward flow of molten metal in the first riser tube; d) a horizontally extending runner interconnecting the riser tube with a fill port in the mold; e) a second pump crucible submerged in the reservoir, the second pump crucible having a second check valve positioned in a passageway in a bottom wall of the second pump crucible such that the second pump crucible will fill with molten metal to a third depth equal to the first depth; e) second pump crucible submerged in the reservoir, the second pump crucible having a second check valve positioned in a passageway in a bottom wall of the second pump crucible such that the second pump crucible will fill with molten metal to the third depth equal to the first depth; f) a high pressure source of inert gas interconnected to the first pump crucible and to the second pump crucible by a gas delivery system including piping, a pressure regulator, two flow valves, one for each the first and the second pump crucible, and a controller to switch between the two flow valves; g) a second riser tube extending upwardly from the second pump crucible, a second check valve in a bottom end of the riser tube to prevent downward flow of molten metal in the second riser tube; whereby opening one of the flow valve permits the inert gas to force the molten metal in a respective pump crucible up the riser tube through the horizontally extending runner into the fill port and switching to the other flow valve provides continuous flow of molten metal to the horizontally extending runner. The high pressure source of inert gas is preferably a tank of nitrogen maintained at 3000 psi and the pressure regulator supplies pressurized gas to the molten metal crucibles at no greater than 20 psi. The crucibles are manufactured from graphite and the riser tubes from refractory, ceramic or graphite.

The first and second check valves have a float ball having a first diameter, an end of the first and second riser tube being spaced from an upper surface of the check valve by a distance less than the first diameter to ensure the float ball remains captive in its respective check valve. Each of the crucibles has a lid which is cast around its respective riser tube to ensure absence of pressure loss between the lid and the riser tube.

In addition, the present invention includes a method of bottom-filling a mold with molten metal comprising the steps of a) providing two graphite crucibles submerged in a reservoir of molten metal, each the crucible being in fluid communication with the reservoir through a check valve; b) subjecting an interior compartment of a first one of the two graphite crucibles to a pressure in a range of between 12 and 20 psi forcing the molten metal within the first crucible past a first check valve up a first vertically positioned riser tube into a horizontally extending runner, through a fill port into the mold; c) switching pressure application from the first crucible to the second one of the two graphite crucibles, venting the first crucible to atmosphere enabling the first crucible to refill, the pressure range of between 12 and 20 psi forcing the molten metal within the second crucible past a second check valve up a second vertically positioned riser tube into the horizontally extending runner through the fill port into the mold; d) switching pressure back and forth between the second and first crucibles as often as needed to complete the fill process; whereby flow of molten metal from the first and second crucibles occurs continuously until filling of the mold is completed.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which The FIGURE is a schematic drawing of a first embodiment of the system for pumping molten metal of the present invention.

DETAILED DESCRIPTION OF THE PREFERRED EMBODIMENT(S)

A first embodiment of the system for pumping molten metal is shown in The FIGURE generally at 20. Reservoir 11 houses molten metal 13 and is replenished by a ladle 15 which is shuttled back and forth from a melter (not shown) to refill the reservoir 11 and maintain the level of molten metal 13 within certain desired parameters. A first (22) and second (24) pump crucible are partially submerged in reservoir 11, each having a check valve 26 positioned in a central portion of floor 28, of respective crucibles 22, 24. At atmospheric pressure, check valves 26 will permit molten metal 13 to fill crucible 22 to a second level and crucible 24 to a third level, where second and third levels are most preferably equal to the first level to which reservoir 11 is filled.

Pump crucibles 22, 24 are preferably manufactured of graphite and sealed by castable lids 30, 32 respectively, which are cast around vertically extending riser tubes 40, 42, respectively. By casting lids 30, 32 around riser tubes 40, 42, venting of pressure around riser tubes 40, 42 is prevented enabling pressurization of pump crucibles 22, 24. Riser tubes 40, 42 are preferably made of refractory, ceramic or graphite. Ends 44, 46 of riser tubes 40, 42, respectively, are positioned from floor 28 by a distance less than the diameter of check valve 26 to prevent the possibility of it becoming dislodged from its valve housing. Each lower end 44, 46 is equipped with a check valve 50, 52 to prevent back flow of molten metal from riser tubes 40, 42 into the crucibles 22, 24. Upper ends 43, 45 of riser tubes 40, 42 are connected to a horizontally extending runner 48 that engages a fill port 49 for distribution of molten metal 13 to casting 17.

While "fill port", for ease of description, is referenced as being singular, and shown in The FIGURE as extending to each side, typically a plurality of fill channels will branch out (in the direction into the drawing) and extend to each side of the casting 17 to facilitate filling the mold. Styrofoam surrounds the fill port 49 to keep it insulated and reduce the rate of cooling of the molten metal 13. A supply tank 60 of high pressure inert gas, preferably, nitrogen at 3000 psi, is interconnected to the chambers of crucibles 22, 24 through a gas delivery system that includes a pressure regulator 62, valves 64, 66, respectively, mounted on supply pipes 68, 70 for crucibles 22, 24. Conventional control circuitry, not shown, enables output pressures typically in a range of between 12 and 20 psi to be switched from crucible 22 to crucible 24 and back again, as often as needed to complete the filing of the bottom fill mold. By way of example and not limitation, the crucibles 22, 24 typically hold 2500 pounds of molten metal and the pumping system will supply 2000# from each, before switching to the other crucible. Casting 17 depicted in the FIGURE typically requires 18000# of aluminum to complete. Accordingly, the pump system 20 will switch 9 times in order to complete the molding process.

The method of the present invention comprises the steps of a) providing two graphite crucibles 22, 24 submerged in a reservoir 11 of molten metal 13, each crucible being in fluid communication with the reservoir through a check valve 26; b) subjecting an interior compartment of a first one of the two graphite crucibles to a pressure in a range of between 12 and 20 psi forcing the molten metal within said first crucible past a first check valve 50 up a first vertically positioned riser tube 40 into a horizontally extending runner 48, through a fill port 49 into the mold; c) switching pressure application from the first crucible to the second one of the two graphite crucibles, venting the first crucible to atmosphere enabling the first crucible to refill, the pressure range of between 12 and 20 psi forcing the molten metal within the second crucible past a second check valve 52 up a second vertically positioned riser tube 42 into the horizontally extending runner through said fill port into the mold; d) switching pressure back and forth between the second and first crucibles as often as needed to complete the fill process; whereby flow of molten metal from the first and second crucibles occurs continuously until filling of the mold is completed.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A system for pumping molten metal to bottom fill a mold, comprising a) a reservoir filled with molten metal to a first depth;

b) a first pump crucible submerged in said reservoir, said first pump crucible having a first check valve positioned in a passageway in a bottom wall of said first pump crucible such that said first pump crucible will fill with molten metal to a second depth equal to said first depth;

c) a first riser tube extending upwardly from said first pump crucible, a first check valve in a bottom end of said riser tube to prevent downward flow of molten metal in said first riser tube;

d) a horizontally extending runner interconnecting said first riser tube with a fill port in said mold;

e) a second pump crucible submerged in said reservoir, said second pump crucible having a second check valve positioned in a passageway in a bottom wall of said second pump crucible such that said second pump crucible will fill with molten metal to a third depth equal to said first depth;

f) a high pressure source of inert gas interconnected to said first pump crucible and to said second pump crucible by a gas delivery system including piping, a pressure regulator, two flow valves, one for each said first and said second pump crucible, and a controller to switch between said two flow valves;

g) a second riser tube extending upwardly from said second pump crucible, a second check valve in a bottom end of said riser tube to prevent downward flow of molten metal in said second riser tube;

whereby opening one of said flow valve permits said inert gas to force said molten metal in a respective pump crucible up said riser tube through said horizontally extending runner into said fill port and switching to said other flow valve provides continuous flow of molten metal to said horizontally extending runner.

2. The system of claim 1 wherein said high pressure source of inert gas is a tank of nitrogen maintained at 3000 psi and said pressure regulator supplies pressurized gas to said molten metal crucibles at no greater than 20 psi.

3. The system of claim 1 wherein said crucibles are manufactured from graphite and said riser tubes from a material selected from a group consisting of refractory, ceramic and graphite.

4. The system of claim 3 wherein each of said first and second check valves have a check ball having a first diameter, an end of said first and second riser tube being spaced from an upper surface of said check valve by a distance less than said first diameter to ensure said float ball remains captive in its respective check valve.

5. The system of claim 3 wherein each of said crucibles has a lid which is cast around its respective riser tube to ensure absence of pressure loss between said lid and said riser tube.

6. A method of bottom-filling a mold with molten metal comprising the steps of a) providing two graphite crucibles submerged in a reservoir of molten metal, each said crucible being in fluid communication with said reservoir through a check valve;

b) subjecting an interior compartment of a first one of said two graphite crucibles to a pressure in a range of between 12 and 20 psi forcing the molten metal within said first crucible past a first check valve up a first vertically positioned riser tube into a horizontally extending runner, through a fill port into said mold;

c) switching pressure application from said first crucible to said second one of said two graphite crucibles, venting said first crucible to atmosphere enabling said first crucible to refill, said pressure range of between 12 and 20 psi forcing said molten metal within said second crucible past a second check valve up a second vertically positioned riser tube into said horizontally extending runner through said fill port into said mold;

d) switching pressure back and forth between said second and first crucibles as often as needed to complete the fill process;

whereby flow of molten metal from said first and second crucibles occurs continuously until filling of said mold is completed.

* * * * *